US005993178A

United States Patent [19]

Park et al.

[11] Patent Number: 5,993,178

[45] Date of Patent: Nov. 30, 1999

[54] LINEAR COMPRESSOR

[75] Inventors: Jung Sik Park, Seoul; Hysong Kook Lee; Byeong Ha Kwon, both of Kyungki-Do, all of Rep. of Korea

[73] Assignee: LG Electronics, Inc., Rep. of Korea

[21] Appl. No.: 08/854,066

[22] Filed: May 8, 1997

[30] Foreign Application Priority Data

| | | | |
|---|---|---|---|
| May 6, 1996 | [KR] | Rep. of Korea | 96-20018 |
| Aug. 5, 1996 | [KR] | Rep. of Korea | 96-15066 |
| Aug. 5, 1996 | [KR] | Rep. of Korea | 96-15067 |

[51] Int. Cl.[6] ..... F04B 39/10

[52] U.S. Cl. ..... 417/545; 417/416

[58] Field of Search ..... 417/415, 416, 417/417, 312, 545, 550; 92/110, 113, 114, 130 R, 130 B, 130 C, 130 D, 131

[56] References Cited

U.S. PATENT DOCUMENTS

| | | | |
|---|---|---|---|
| 3,329,334 | 7/1967 | Curwen | 417/417 |
| 3,814,550 | 6/1974 | Adams | 417/417 |
| 4,261,689 | 4/1981 | Takahashi | 417/550 |
| 4,370,104 | 1/1983 | Nelson et al. | 417/312 |
| 5,722,817 | 3/1998 | Park et al. | 417/550 |

*Primary Examiner*—Charles G. Freay

*Attorney, Agent, or Firm*—Ostrolenk, Faber, Gerb & Soffen, LLP

[57] ABSTRACT

A linear compressor includes a piston that is slidably mounted in a cylinder. An hermetic spring holder has an end portion which is connected to a corresponding portion of the cylinder and which surrounds the cylinder while being located at a predetermined distance therefrom. A cap is fixedly connected to another end portion of the hermetic spring holder. A refrigerant suction guide tube is inserted from a refrigerant suction side into the piston. A spring supports the piston. The compressor causes refrigerant gas to flow solely through the refrigerant suction tube so that the internal refrigerant gas flow path of the piston is larger and the structure simpler. Thereby, damage to the path is decreased, the flow of refrigerant gas is more smooth and heat generated in the heated piston is blocked from being transferred to the refrigerant gas.

11 Claims, 8 Drawing Sheets

LINEAR COMPRESSOR

BACKGROUND OF THE INVENTION

1. Field of the Invention

The present invention relates to a linear compressor, and more particularly to an improved linear compressor employing an axial flow valve system, wherein a refrigerant suction guide hole is axially formed through an interior of a piston which is slidingly provided in a cylinder and supported by a spring.

2. Description of the Conventional Art

In order to solve disadvantages of a linear compressor adopting a crank shaft, a magnet and coil assembly replacing the crank shaft has been employed for a shuttle movement of a piston, thereby decreasing compressor parts number and production cost, and enhancing productivity.

As shown in FIG. 1, such a conventional linear compressor includes a cylinder 2 provided in a hermetic vessel 1 which has a predetermined shape.

In the cylinder 2, coil assemblies 3, 3' are assembled into a single body.

A piston spring 4 is fixed to a lower portion of the cylinder 2 thus to be connected to a lower circumferential portion of the cylinder 2, and a plurality of mounting springs 7 provided between the piston spring 4 and an inner bottom portion of the hermetic vessel 1 serve to elastically support the piston spring 4.

A piston 5 is fixed to a center portion of an upper surface of the piston spring 4 so as to carry out a linear shuttle movement in the cylinder 2.

A magnet 6 is fixedly attached along an outer periphery of the piston 5, and a valve assembly 8 is fixed to a side portion of an upper surface of the cylinder 2. A suction side muffler 9 and an exhaustion side muffler 10 are respectively installed adjacent to each side of the valve assembly 8.

The thusly constituted conventional linear compressor repeatedly carries out sequential operations of suction, compression and exhaustion of refrigerant gas in accordance with a repeated linear shuttle movement of the piston 5.

With regard to operation of the conventional linear compressor, because an assured opening/closing operation of a suction valve and an exhaust valve which control the flow of refrigerant gas serves as a significant factor in improving compressor efficiency, there is widely known a linear compressor employing an axial flow valve system in order for the flow direction of refrigerant gas to be directed identically to that of piston movement.

An inertia-applied valve apparatus applicable to a reciprocal movement compressor serving as an example of the axial flow valve system will now be described.

As shown in FIG. 2 illustrating the inertia-applied valve apparatus, a recess 21*a* is formed in and along an inner peripheral portion of a cylinder 21, and a plurality of refrigerant suction holes 21*b* are respectively formed through a portion of the bottom surface of the recess 21*a* so as to communicate with an exterior of the cylinder 21.

A chamfer opening 22*a* is formed outside each chamfer of an end of the piston 22 which is received in the cylinder 21 so as to communicated with the recess 21*a*.

A suction valve 23 is caulked around a center portion of a top surface of the piston 22 by a piston pin 24.

To an end of the cylinder 21 there is connected a head cover 25 which communicates with an interior of the cylinder 21.

A spring 27 is connected to an inner side portion of the head cover 25, and an exhaust valve 26 is connected to an end portion of the spring 27 and elastically supported by the spring 27.

Through a predetermined portion of the head cover 25 there is formed a refrigerant gas exhaust hole 25*a* to communicate with an exterior of the head cover 25.

When refrigerant gas compressed in a compression space C of the cylinder 21 pushes the exhaust valve 26 against the elasticity of the spring 27, the compressed refrigerant gas exhausts through the refrigerant exhaust hole 25*a* at the head cover 25.

In the thusly constituted conventional linear compressor employing an axial flow valve system, when refrigerant gas is sucked into the cylinder 21 via the refrigerant suction hole 21*b* and the recess 22*a* at the cylinder 21, the suction valve 23 becomes spaced from the piston 22 in accordance with a pressure difference between respective side end portions of the suction valve 23 for thereby facilitating an intake stroke of the piston 22 as shown in FIG. 2, so that when the suction valve 23 is moved toward a direction further away from the exhaust valve 26, the refrigerant is sucked into the compression space C through a gap between the suction valve 23 and the piston 22.

The refrigerant sucked into the compression space C is compressed during a compression stroke of the piston 22, and accordingly the exhaust valve 26 is moved toward a direction against the elasticity of the spring 27, whereby the refrigerant is exhausted through the refrigerant exhaust hole 25*a* formed at the head cover 25.

After the compression stroke of the piston 22, the piston 22 causes the suction valve 23 moved toward a front direction of the piston 22 to move in a direction facing against the exhaust valve 26 for thereby repeating the above-described suction operation. At this time, the suction valve 26 returns to an initial state in response to the restoring force of the spring 27.

However, the linear compressor without employing an axial flow valve system as shown in FIG. 1 is provided with the muffler 9 installed at an entrance of a refrigerant path adjacent to the valve assembly 8, and noise occurring around the entrance of the refrigerant path can be efficiently muffled. Meanwhile, despite a great need for reducing suction noise resulting from the suction side opening of the refrigerant path, because there exists a structural disadvantage in which the flow direction of refrigerant is identical to the movement direction of the piston, the linear compressor employing the axial flow valve system as shown in FIG. 1 which is widely accepted due to its assured valve opening/closing operation is not appropriate to installing an suction side muffler as in the linear compressor without employing an axial flow valve system as shown in FIG. 1 and further it is not equipped with an extra noise reduction apparatus therein, thereby presenting a serious noise problem.

With reference to Korean Patent Application No. 25666 filed by the present patent applicant in 1995, in order to solve the above-described problems, a linear compressor as shown in FIG. 3 is provided with a piston 32 slidingly combined in the cylinder 31, wherein the piston 32 is separately comprised of an outer piston 33 combined along an inner periphery of the cylinder 31, a rod post 34 provided within the outer piston 33, and a piston rod 35 connected through the rod post 34.

In the linear compressor as shown in FIG. 3, between the piston rod 35 and the rod post 34 there is formed a first silencer 36 which communicates with an entrance portion of refrigerant gas path, and between the rod post 34 and the outer piston 33 there is formed a second silencer 37 which communicates with the first silencer 36.

At apredetermined portion of the rod post 34 there is formed a hole 34*a* in order for the first silencer 36 and the second silencer 37 to communicate with each other.

In each side portion of an end surface of the piston 32 there is formed a piston hole 32*a,* and a suction valve 41 is caulked in a center portion of the piston 32 by a piston pin 42.

In a housing recess 43*a* covered by a head cover 43 which is fixed to each side portion of the cylinder 31 there are insertingly provided a first exhaust valve 44, a second exhaust valve 45, a stopper 46 and a spring 47.

Between the hermetic vessel 55 and cylinder 31 there is provided a hermetic spring holder 51 each end portion of which is connected to a predetermined portion of the cylinder 31 and which has a shape surrounding the cylinder 31.

At this time, an entrance portion of the hermetic spring holder 51 positioned along a direction toward which the refrigerant gas is sucked is connected to the cap 52 having a suction tube 54 formed through a portion thereof, wherein the refrigerant suction tube 54 serves to suck the refrigerant gas therethrough.

As a result, there is formed a third silencer 53 inside of the cap 52, for thereby doubling noise reduction efficiency.

Meanwhile, a dominant equation for a mechanism of the thusly composed linear compressor is as follows:

$$\ddot{X}=1/m\ \{\alpha I-A_p(P_w-P_b)-(\dot{X}-KX)\}$$

wherein, m=moving mass including a piston;

$A_p$ area of front side of the piston;

$P_w$=pressure of compression portion;

$P_b$=pressure of rear portion of the piston;

K=stiffness of a mechanical spring; and

C=damping coefficient.

Here, spring constant K required to operate the linear compressor has come into existence, and in order to satisfy spring constant K, there is employed a plate spring 28 as shown in FIG. 4.

The plate spring 28 is assembled with the piston rod 35.

Reference numeral 48 denotes a refrigerant exhaust tube, reference numeral 56 denotes an external refrigerant suction tube, and reference numeral 57 denotes an external refrigerant exhaust tube. Here, the refrigerant exhaust tube 48 and the external refrigerant exhaust tube 57 communicate with each other, though not illustrated in the drawing, with reference to FIG. 3, the operation of noise reduction apparatus of the conventional linear compressor will now be described.

When the linear compressor shown in FIG. 3 starts operation, refrigerant gas is sucked through the external refrigerant suction tube 56 at the hermetic vessel 55, and the sucked refrigerant gas flows through the internal refrigerant suction tube 54 formed through the cap 52 to the third silencer 53 attain a primary noise reduction.

Then, the refrigerant gas flows along the arrow direction from a rear side of the cylinder 31 and through the refrigerant gas path into the cylinder 31. At this time, because the first silencer 36 is formed between the piston rod 35 and the rod post 34, when the refrigerant gas passes through the first silencer 36, there is obtained a secondary noise reduction effect.

A tertiary noise reduction effect is obtained when the refrigerant gas passes through the second silencer 37 formed between the rod post 34 and the piston 33 after passing through the hole 34*a* formed through the rod post 34.

Next, the refrigerant gas that has flowed into the compression space C in the cylinder 31 after passing through the piston hole 32*a* of the piston 32 and the suction valve 42, respectively, moves toward the first exhaust valve 44 in order for the piston 32 to carry out a compression stroke thereof. Then, passing through the first and second exhaust valves 44, 45, the refrigerant gas is externally exhausted through the refrigerant exhaust tube 48 of the head cover 43.

At this time, the stopper 46 serves to prevent the second exhaust valve 45 from moving excessively.

However, in the linear compressor shown in FIG. 3, the refrigerant gas which passed through the external refrigerant suction tube 56 is flowed through the internal refrigerant suction tube 54, which is formed at the cap 52 as a tiny hole, into the inner space of the linear compressor, and further in order for the refrigerant gas to flow into the cylinder 31, the refrigerant gas should pass through the piston 32 which has a complicated structure.

That is, conventionally, the externally sucked refrigerant gas is heated while passing through the internal refrigerant path of the piston 32 remains at a high temperature, whereby volume of the refrigerant gas becomes increases, and a cooling efficiency of the refrigerant gas deteriorates. In addition, an increased refrigerant path damage has been taken place resulting from the narrow internal refrigerant path in the piston.

Further, the conventional linear compressor has a disadvantage in that the outer piston 33, the rod post 34 and the piston rod 35 which are formed into the piston assembly need be connected to each other using a heat compression method.

SUMMARY OF THE INVENTION

Accordingly, it is a first object of the present invention to provide a linear compressor capable of preventing refrigerant gas on moving through a gas path from being lost by simplifying the path and smoothing the flow of the refrigerant gas.

It is a second object of the present invention to provide a linear compressor in which refrigerant gas suction is not influenced by a cap thereof.

It is a third object of the present invention to provide a linear compressor including a spring which is sufficiently stiff to support a piston and enables the refrigerant gas to secure a suction path.

It is a fourth object of the present invention to provide a linear compressor for preventing refrigerant gas from being heated when the sucked refrigerant gas passes through the piston.

It is a fifth object of the present invention to provide a linear compressor including a piston support spring for leading to an improved productivity.

To achieve the above-described objects, there is provided a linear compressor which includes a piston for being slidably mounted in a cylinder, a hermetic spring holder an end portion of which is connected to a corresponding portion of the cylinder and which surrounds the cylinder having a predetermined spacing therebetween, a cap for being fixedly connected to another end portion of the hermetic spring holder, a refrigerant suction guide tube for being inserted from a refrigerant suction side into the piston, and a spring for supporting the piston.

DETAILED DESCRIPTION OF THE PREFERRED EMBODIMENTS

With reference to the accompanying drawings, the linear compressor according to preferred embodiments of the present invention will now be described.

Figure 5:
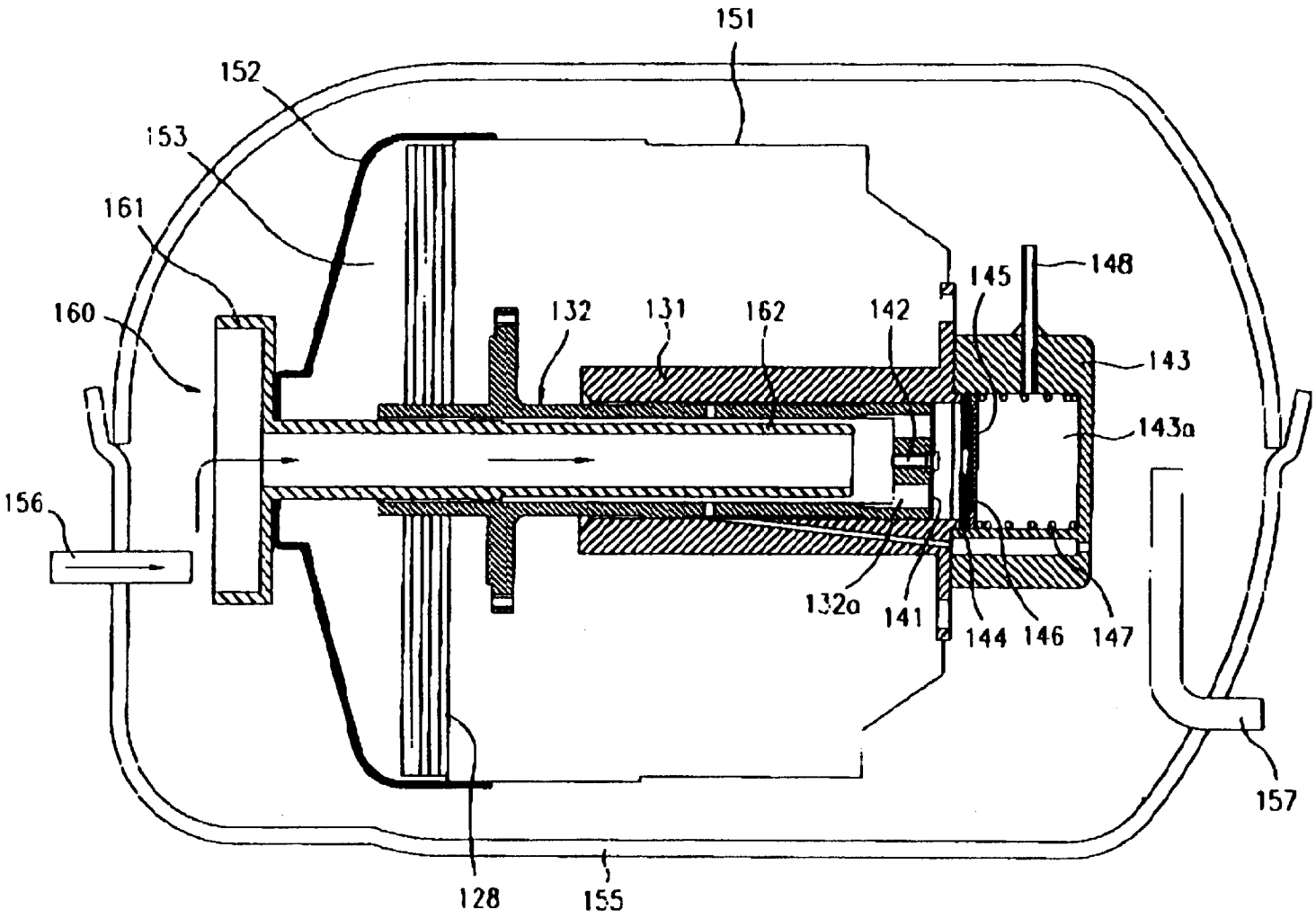
FIG. 5 is a cross-sectional view of a linear compressor according to a first embodiment of the present invention.

As shown in FIG. 5, the linear compressor according to the first embodiment of the present invention includes a piston 132 slidingly movable in a cylinder 131. Through each side portion of a top surface of the piston 132 there is formed a piston hole 132*a*. A piston pin 142 is caulked through a center portion of the top surface of the piston 132 by a suction valve 141.

In a housing recess 143*a* covered by a head cover 143 which is fixed to a circumferential surface of the cylinder 131 there are insertingly provided a first exhaust valve 144, a second exhaust valve 145, a stopper 146 and a spring 147.

Between the hermetic vessel 155 and cylinder 131 there is provided a hermetic spring holder 151 each end portion of which is connected to a predetermined portion of the cylinder 131 and which has a shape surrounding the cylinder 131.

At this time, an entrance portion of the hermetic spring holder 151 is positioned along a direction toward which refrigerant gas is sucked and it is fixedly connected to the cap 152 within which there is formed a silencer 153 for reducing noise.

Into the piston 132 there is inserted a refrigerant suction guide tube 160 which extends lengthwise and penetrates a center portion of the cap 152 from exterior to interior and which is extended adjacent to the suction valve 141 for thereby guiding the flow of refrigerant gas.

With regard to the detailed structure of the refrigerant suction guide tube 160, the tube 160 includes a suction muffler 161 formed adjacent to an external refrigerant suction tube 156 through which is sucked refrigerant gas, and a refrigerant gas flow path 162 for guiding the refrigerant gas therethrough and being extended until it reaches the region adjacent to the suction valve 141.

At this time, the refrigerant suction guide tube 160 is desirably formed of low thermal conductivity material such as plastic so that large amounts of heat generated in the piston 132 is prevented from being transferred to the refrigerant gas.

Inside the cap 152, there is installed a plate spring 128 which supports the piston 132 including the refrigerant suction guide tube 160 therein.

Reference numeral 148 denotes a refrigerant exhaust tube, reference numeral 156 denotes an external refrigerant suction tube, and reference numeral 157 denotes an external refrigerant suction tube.

Figure 1:
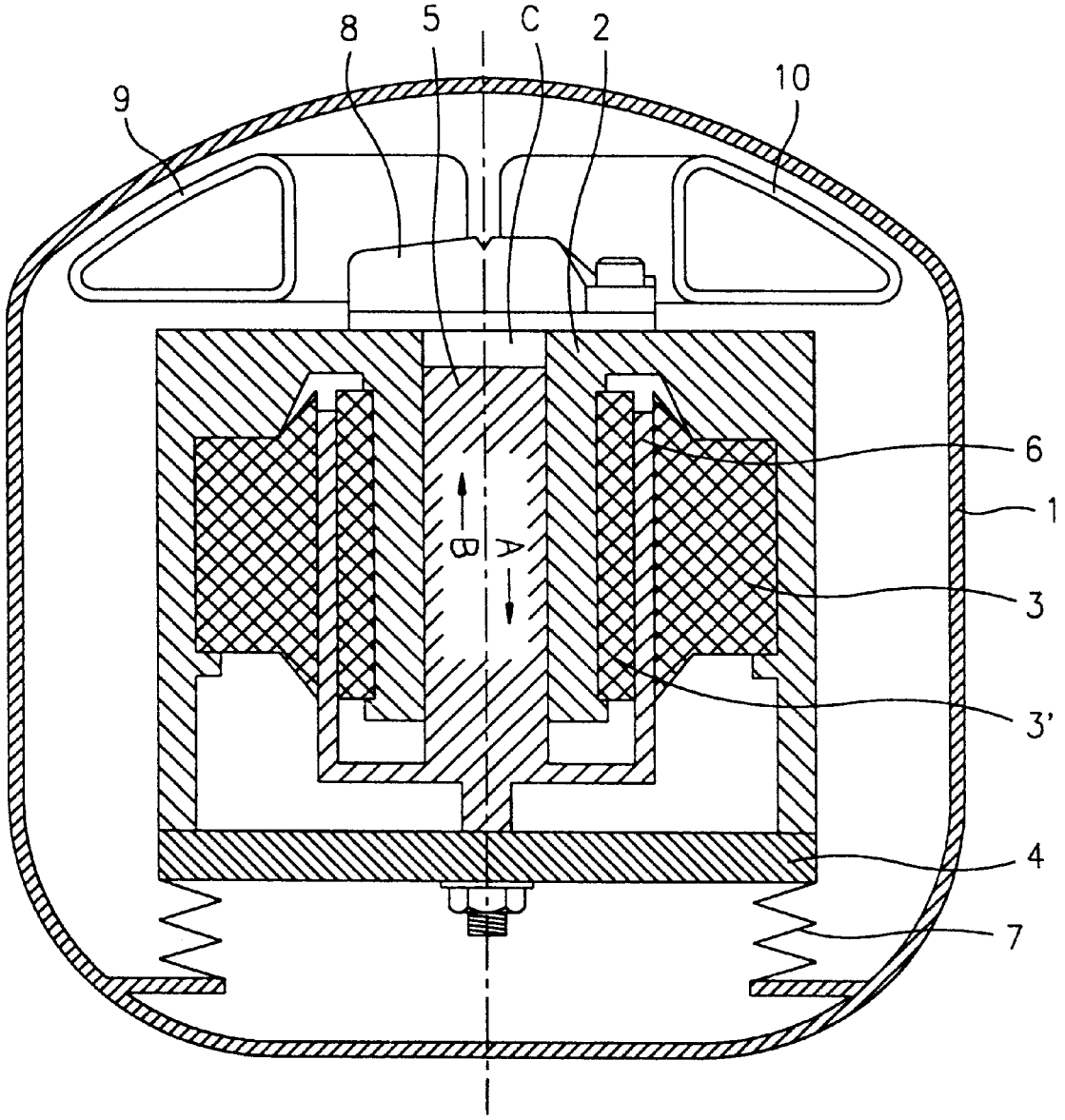
FIG. 1 CONVENTIONAL ART
FIG. 1 is a cross-sectional view of a linear compressor according to a conventional art.
Figure 2:
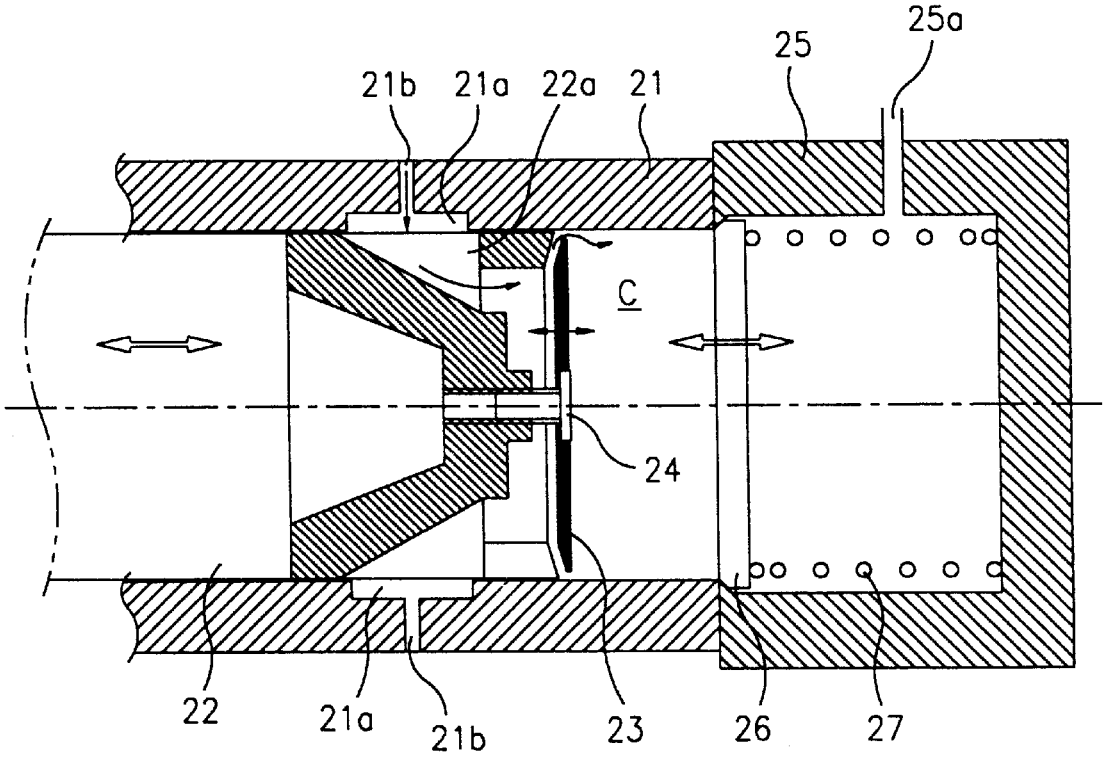
FIG. 2 CONVENTIONAL ART
FIG. 2 is a cross-sectional view of a linear compressor equipped with an axial flow valve system according to a conventional art.
Figure 3:
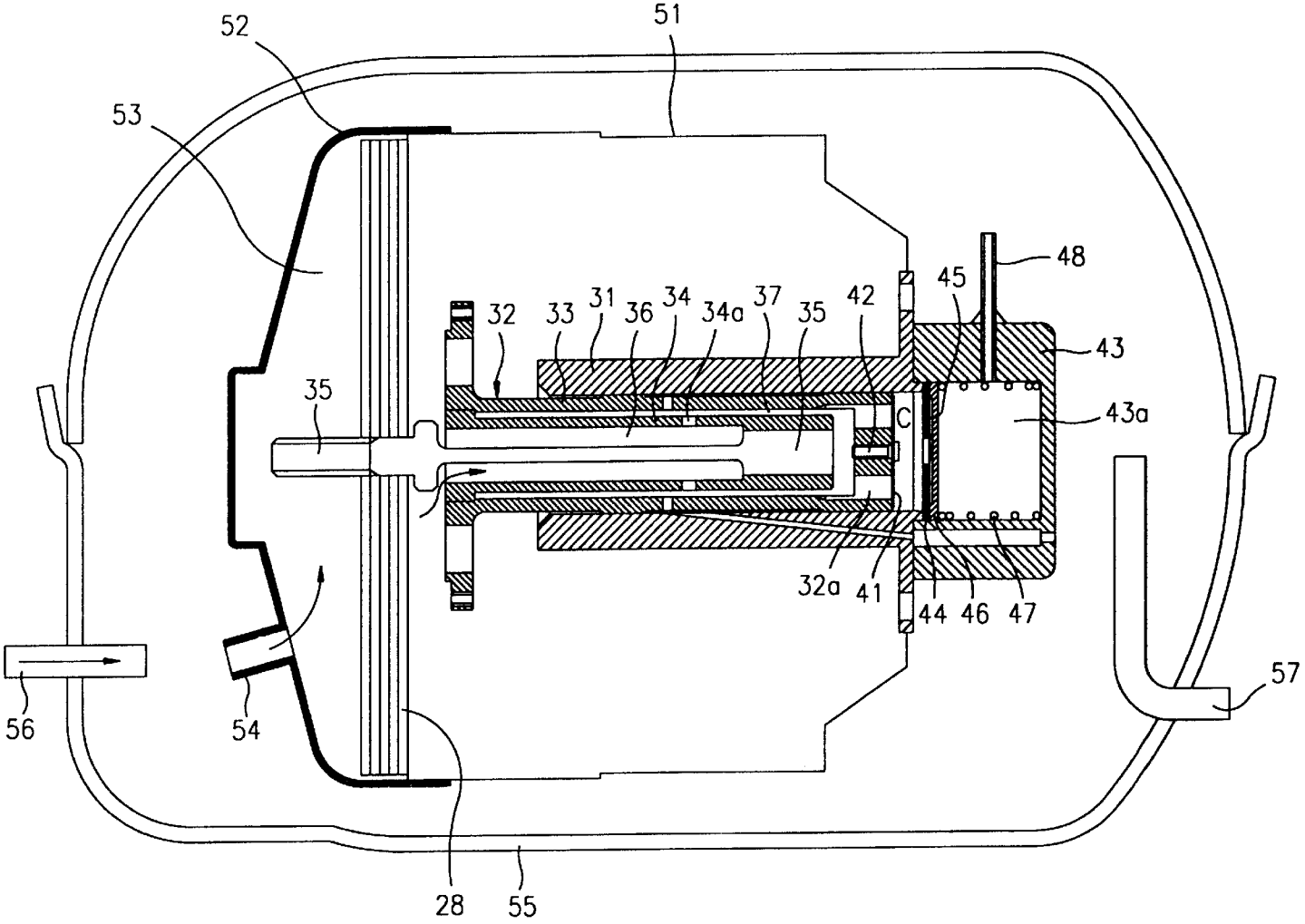
FIG. 3 CONVENTIONAL ART
FIG. 3 is a cross-sectional view of another linear compressor equipped with an axial flow valve system according to a conventional art in relation to a Korean Patent Application filed by the present applicant.
Figure 4:
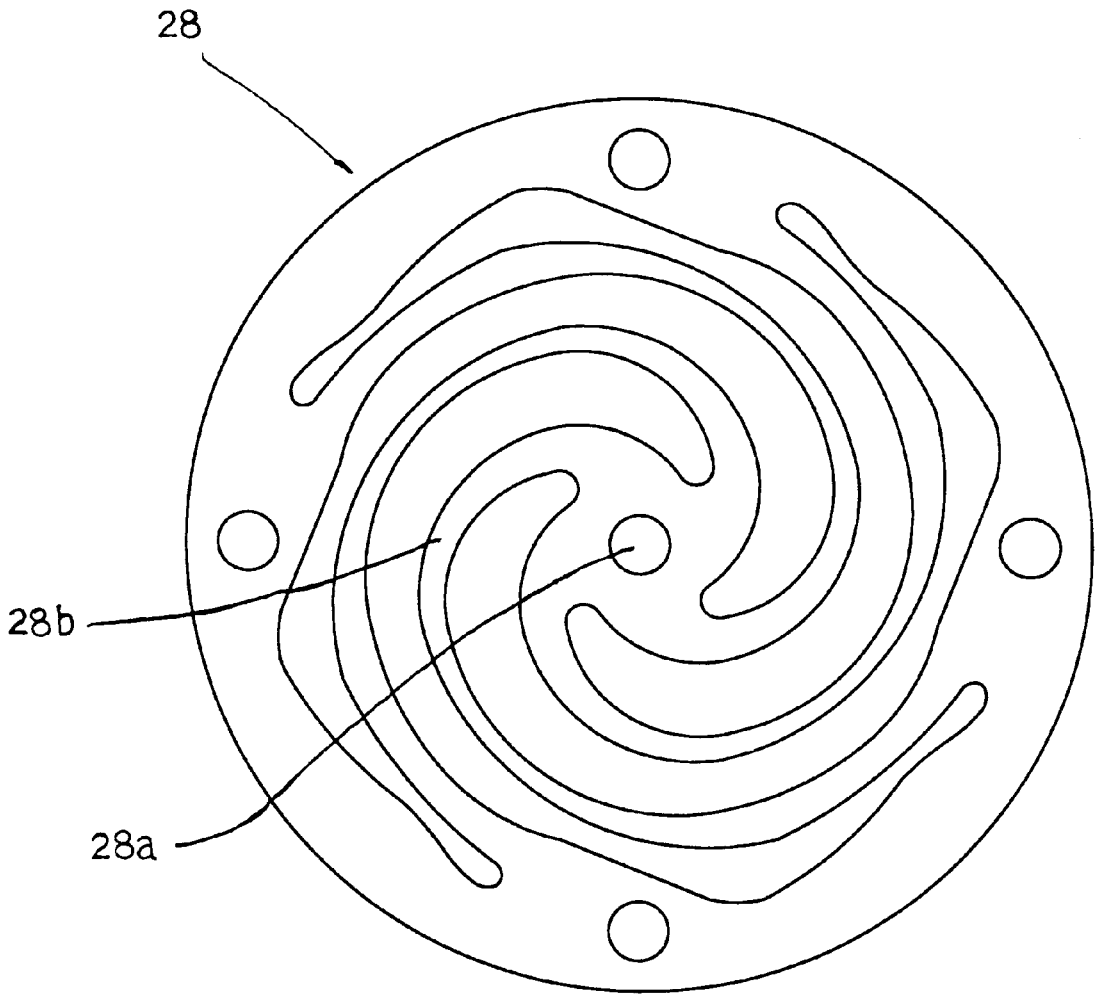
FIG. 4 CONVENTIONAL ART
FIG. 4 is a cross-sectional view illustrating a plate spring in FIG. 3.

The refrigerant suction structure of the linear compressor according to the first embodiment of the present invention excludes the conventional components of the piston installed in the cylinder 131, such as the piston rod 35, the rod post 34 and the like as shown in FIG. 3 and includes instead the refrigerant suction guide tube 160. Here, the refrigerant gas sucked into the cylinder 131 is passed only through the refrigerant suction guide tube 160, so that heat transmission from the heated piston 132 to the refrigerant gas is blocked, and further noise is reduced by the suction muffler 161 for thereby smoothing the flow of refrigerant gas.

Figure 6:
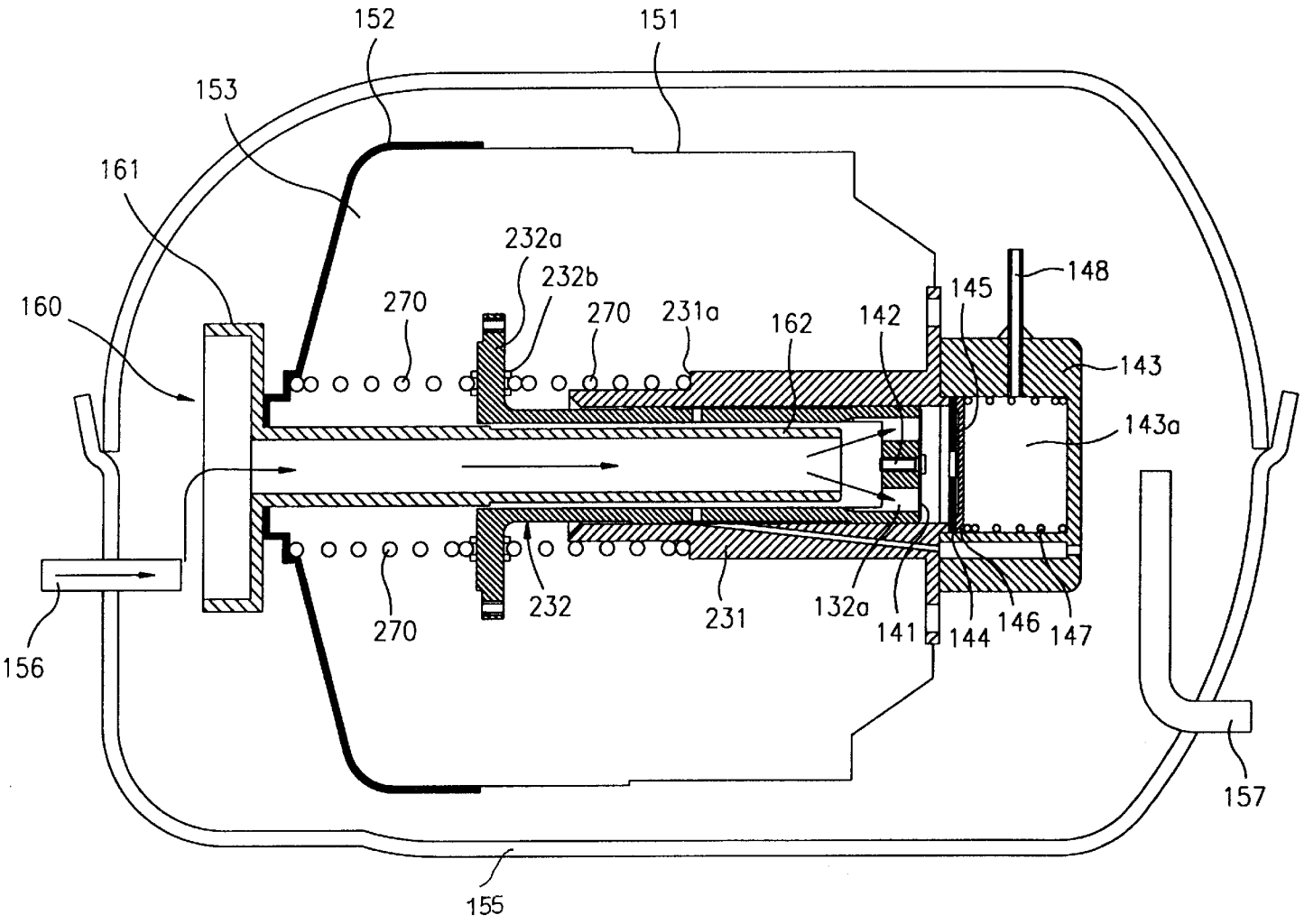
FIG. 6 is a cross-sectional view of a linear compressor according to a second embodiment of the present invention.

With reference to FIG. 6, a refrigerant suction structure of the linear compressor according to the second embodiment of the present invention will now be described, wherein since the refrigerant suction structure of the linear compressor according to the second embodiment of the present invention is similar to that of the first embodiment of the present invention, the description of components identical to the first embodiment is omitted and same reference numerals are employed. That portion of the structure of the second embodiment of the present invention which is different from that of the first embodiment will now be described.

The refrigerant suction structure of the linear compressor according to the second embodiment of the present invention as shown in FIG. 6 excludes the plate spring employed in the first embodiment of the present invention and instead includes a mass-producible coil spring 270 provided along the refrigerant suction guide tube 160 between a flange unit 232*a* extended from the piston 232 and the cap 152.

The coil spring 270 is also provided along the refrigerant suction guide tube 160 between a stepped portion 231*a* of the cylinder 231 and the flange unit 232*a* of the piston 232.

A spring holding unit 232*b* is formed on each side of the flange unit 232*a* so as to abuttingly support the respective coil springs 270.

Figure 7:
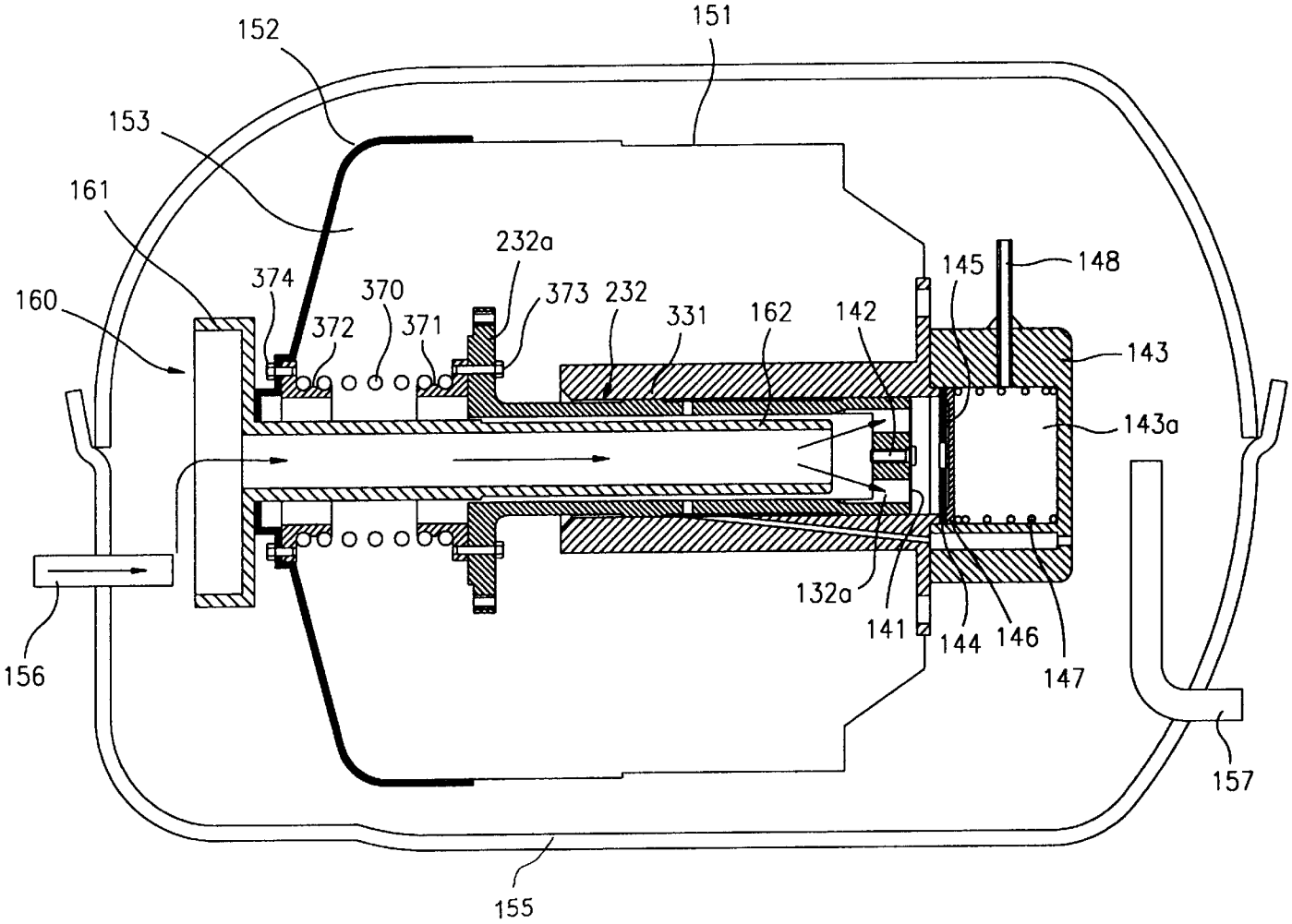
FIG. 7 is a cross-sectional view of a linear compressor according to a third embodiment of the present invention.

With reference to FIG. 7, a refrigerant suction structure of the linear compressor according to the third embodiment of the present invention will now be described, wherein since the refrigerant suction structure of the linear compressor according to the third embodiment of the present invention is similar to that of the second embodiment of the present invention, the description of components identical to the second embodiment is omitted and the same reference numerals are employed. That portion of the structure of the third embodiment of the present invention which is different from that of the second embodiment will now be described.

The refrigerant suction structure of the linear compressor according to the third embodiment of the present invention as shown in FIG. 7 is provided with a coil spring 370 between the flange unit 232*a* extended from the piston 232 and the cap 152, and in order to abuttingly support the coil spring 370 there are formed a first static flange 371 facing toward the cap 152 and positioned on an end portion of the piston 232, and a second static flange 372 positioned inside the cap 152 so as to face against the cap 152.

At this time, a screw tap is formed in each upper portion of the first and second flanges 371, 372 so that the first and second flanges 371, 372 can be fixed into the flange unit 232*a* and the cap 152, respectively, by using corresponding screws 373, 374.

The outer peripheral surfaces of the first and second static flanges 371, 372 are formed to have screw taps 371*a*, 372*a* thereon, respectively, so that the coil spring 370 is fixed thereto.

According to the third embodiment of the present invention, each end portion of the coil spring 370 is fixed as described above, whereby the coil spring 370 is not required to be pre-compressed prior to its mounting.

Figure 8:
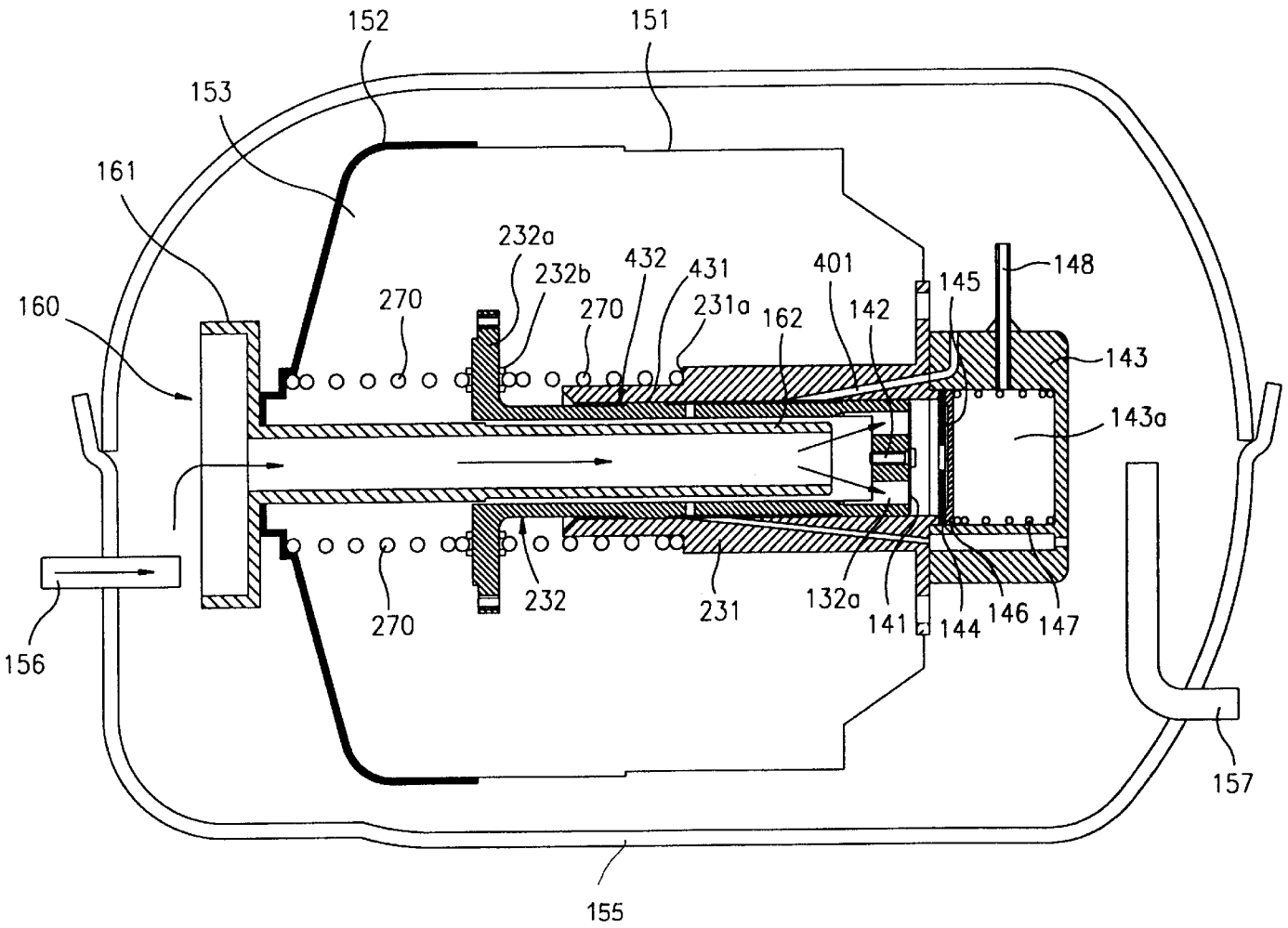
FIG. 8 is a cross-sectional view of a linear compressor according to a fourth embodiment of the present invention.

Referring to FIG. 8, a refrigerant suction structure of the linear compressor according to the fourth embodiment of the present invention will now be described, wherein since the refrigerant suction structure of the linear compressor according to the fourth embodiment of the present invention is similar to that of the second embodiment of the present invention, the description of components identical to the second embodiment is omitted and the same reference numerals as in FIG. 6 are employed. That portion of the structure of the fourth embodiment of the present invention which is different from that of the second embodiment will now be described.

According to the refrigerant suction structure of the linear compressor according to the fourth embodiment of the present invention as shown in FIG. 8, there is formed an oil flow path 401 which communicates from the outer periphery of the piston 32 or an inner periphery of the cylinder 31 to a surface portion of the head cover 43.

Therefore, the oil supplied from an oil supply member (not shown) is caused to flow through the oil flow path 401 directly and surely to an oil compression surface of the cylinder 31, thereby improving lubrication in the oil compression surface and workability of the linear compressor.

As described above, the linear compressor according to the present invention causes refrigerant gas to flow solely through the refrigerant suction tube with regard to the refrigerant gas being flowed into the cylinder, so that the internal refrigerant gas flow path of the piston becomes larger and simpler in structure, thereby significantly decreasing damage to the path, smoothing the flow of refrigerant gas and blocking the heat occurring in the heated piston from being transferred to the refrigerant.

Further, the piston is supported by the coil spring, thereby securing the smoothed refrigerant suction path.

What is claimed is:

1. A linear compressor, comprising:

a cylinder;

a piston slidingly mounted in the cylinder;

a hermetic spring holder having a first end portion which is connected to a corresponding portion of the cylinder and which surrounds the cylinder while being spaced a predetermined distance therefrom;

a cap fixedly connected to a second end portion of the hermetic spring holder;

a refrigerant suction guide tube extending from a refrigerant suction side of the cap into the piston; and at least one spring for supporting the piston.

2. The linear compressor of claim 1, wherein the refrigerant suction guide tube includes a suction muffler formed adjacent to an external refrigerant suction tube through which refrigerant gas is sucked, and a refrigerant gas flow path for guiding the refrigerant gas therethrough, the refrigerant gas flow path extending to a region adjacent to a suction valve disposed on a front portion of the piston.

3. The linear compressor of claim 1, wherein the refrigerant suction guide tube penetrates through a center portion of the cap and reaches into the piston.

4. The linear compressor of a claim 1, wherein the refrigerant suction guide tube is formed of material having a low thermal conductivity, such as plastic.

5. The linear compressor of claim 1, wherein the spring comprises a plate spring.

6. The linear compressor of claim 1, wherein the cylinder includes a stepped portion, and the at least one spring comprises two coil springs inserted between the stepped portion of the cylinder and a surface portion of a flange unit extending from the piston and between an inner surface portion of the cap and another surface portion of the flange unit extending from the piston.

7. The linear compressor of claim 6, including a spring fixture unit fixed to an inner side portion of the flange unit and extending from the piston, for supporting an end portion of the coil spring.

8. The linear compressor of claim 1, including a first static flange fixed to an end portion of the piston which faces the cap, a second static flange fixed to an inner surface portion of the cap and a coil spring, whereby the coil spring located between the first static flange and the second static flange comprises the spring.

9. The linear compressor of claim 8, wherein a plurality of screw taps are formed in each of upper surface portions of the first and second flanges and the flanges being fixed to the flange unit and the cap, respectively, by screws.

10. The linear compressor of claim 1, wherein an oil flow path is formed along an outer periphery of the piston so as to communicate to a surface portion of a head cover.

11. The linear compressor of claim 1, wherein an oil flow path is formed through the cylinder so as to communicate from an inner periphery of the cylinder to a surface portion of a head cover.

* * * * *